US007163435B2

(12) United States Patent
Lim et al.

(10) Patent No.: US 7,163,435 B2
(45) Date of Patent: Jan. 16, 2007

(54) REAL TIME MONITORING OF CMP PAD CONDITIONING PROCESS

(75) Inventors: Khoon Peng Lim, Singapore (SG); Kok Eng Lee, Singapore (SG)

(73) Assignee: Tech Semiconductor Singapore Pte. Ltd., Singapore (SG)

( * ) Notice: Subject to any disclaimer, the term of this patent is extended or adjusted under 35 U.S.C. 154(b) by 31 days.

(21) Appl. No.: 11/047,117

(22) Filed: Jan. 31, 2005

(65) Prior Publication Data

US 2006/0172662 A1 Aug. 3, 2006

(51) Int. Cl.
*B24B 1/00* (2006.01)
*B24B 49/00* (2006.01)

(52) U.S. Cl. ..... 451/5; 451/8; 451/41; 451/56

(58) Field of Classification Search ..... 451/5, 451/8, 9, 10, 11, 41, 42, 56
See application file for complete search history.

(56) References Cited

U.S. PATENT DOCUMENTS

| | | | | |
|---|---|---|---|---|
| 5,399,234 | A | 3/1995 | Yu et al. | 156/636 |
| 5,708,506 | A | 1/1998 | Birang | 356/371 |
| 6,424,137 | B1 | 7/2002 | Sampson | 324/76.21 |
| 6,755,718 | B1 | 6/2004 | Moore | 451/5 |
| 2002/0173223 | A1* | 11/2002 | Gitis et al. | 451/5 |
| 2004/0038623 | A1* | 2/2004 | Chandrasekaran | 451/5 |
| 2004/0097169 | A1* | 5/2004 | Moore | 451/8 |
| 2005/0142987 | A1* | 6/2005 | Kramer et al. | 451/5 |

FOREIGN PATENT DOCUMENTS

| | | |
|---|---|---|
| EP | 1063056 A | 12/2000 |
| WO | WO 01/32360 A | 5/2001 |

* cited by examiner

*Primary Examiner*—Jacob K. Ackun, Jr.
(74) *Attorney, Agent, or Firm*—Saile Ackerman LLC; Stephen B. Ackerman

(57) ABSTRACT

CMP pad conditioning processes have been monitored and controlled by detecting the vibrational spectrum of a sensor mounted on the conditioner support arm. An accelerometer is used as the detector so that vibrational velocity (which correlates with pad wear) can be measured, rather than displacement or acceleration. After the vibrational spectrum has been transformed to its frequency domain equivalent, it is monitored for the presence of abnormal peaks in order to control the conditioning process.

22 Claims, 6 Drawing Sheets

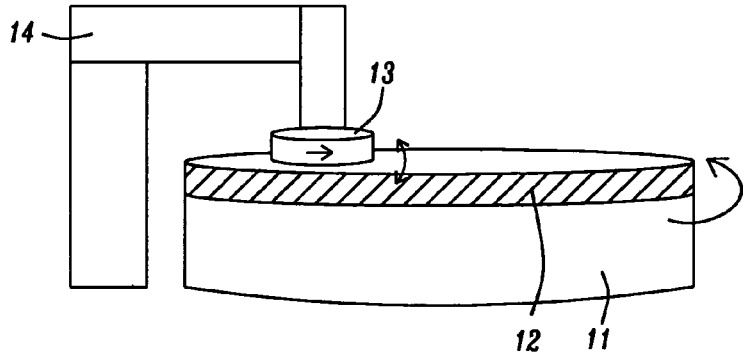
FIG. 1 – Prior Art
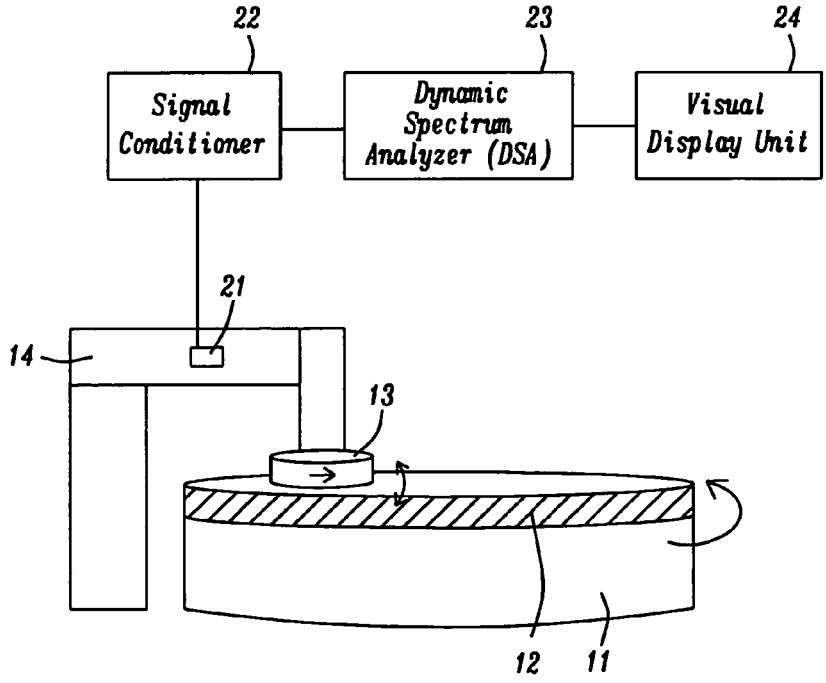
FIG. 2

(a) Time Domain Plot (b) Frequency Domain Plot

REAL TIME MONITORING OF CMP PAD CONDITIONING PROCESS

FIELD OF THE INVENTION

The invention relates to the general field of chemical-mechanical polishing (CMP) with particular reference to conditioning the polishing pads after extended use.

BACKGROUND OF THE INVENTION

CMP has, for many years, been the preferred method for planarizing integrated circuits. As its name implies, this process involves mechanical polishing assisted by chemical action. In CMP, wafers are mounted on a suitable holder and then pressed against a polishing pad that has been attached to a rotating platen. A problem with CMP processing is that the throughput may drop because waste particles accumulate at the surface of the polishing pad. To restore the effectiveness of the polishing pads, they are typically 'conditioned' by using an abrasive disk to remove the waste matter. Such disks are generally embedded with diamond particles and are mounted so as to be independently moveable and rotatable.

FIG. 1 shows a typical arrangement for a CMP pad conditioning disk. Seen there are platen 11 to which is attached polishing pad 12. Conditioning disk 13 is pressed against pad 12 by means of overhead support arm 14 to which it is attached. Generally conditioning disks remove a thin layer of the pad material itself in addition to the waste matter, thereby forming a fresh planarizing surface for the polishing pad.

The conditioning disks themselves may eventually lose their effectiveness by being worn down or by getting plugged up with particulate matter. If a change in effectiveness is not detected, preferably during the conditioning process itself, a sub-standard polishing pad may be inadvertently returned to service, with undesirable consequences. Thus, it is important to minimize the time required for the conditioning process, to maximize the useful life of each polishing pad, and to detect inadequate pads before they are restored to service.

Conventionally, monitoring of CMP pad conditioning processes is performed by trial-and-error wherein different control parameters are varied manually by an operator to achieve optimal conditioning. These control parameters include pressure of the conditioner on the polishing pad, translational and rotational speeds of the conditioner, platen rotation speed, and the number of sweeps over the pad surface made by the conditioner.

The manual adjustments referred to above are based solely on human experience, hence additional manpower is required. Furthermore, it is very difficult to achieve good repeatability for the conditioning process if the manual adjustment is performed by different operators. In view of this, there exists a need for an apparatus and method for monitoring the CMP pad conditioning process that help to extend the life of the polishing pads, reduce human intervention and improve the control of the conditioning process.

A routine search of the prior art was performed with the following references of interest being found:

U.S. Pat. No. 6,755,718, EP 1,063,056A2, WO 01/32,360A1, U.S. Pat. No. 5,708,506, U.S. Pat. No. 6,424,137, and U.S. Pat. No. 5,399,234 all aim to improve the CMP process as well as teaching in-situ monitoring of the pad conditioning process. U.S. Pat. No. 6,424,137 and U.S. Pat. No. 5,399,234 relate to the use of acoustic analysis for monitoring of CMP process. U.S. Pat. No. 6,424,137 teaches detection of wafer vibration characteristics to minimize wafer damage during polishing by placing a sensor directly on the wafer, while U.S. Pat. No. 5,399,234 discloses the use of acoustic waves generated in the polishing slurry to determine the end-point of the polishing process by placing a sensor in the slurry. Both of these prior art references seek to improve the CMP wafer polishing process rather than the pad conditioning process.

In U.S. Pat. No. 5,708,506 the roughness of the pad is determined by employing a light source that impinges on the polishing pad and a light detector for detecting the light emanating from the polishing surface. In WO 01/3,2360A1, ultrasonic transducers are employed to measure the thickness of the layers on the polishing pad and the result used to control process variables. EP 1,063,056A2 relates to a method and apparatus whereby a contactless displacement sensor is used to generate the polishing pad profile and to monitor the pad wear uniformity. In U.S. Pat. No. 6,755,718, a force sensor is mounted on the conditioner to detect the frictional force imparted to the conditioning body by the planarizing medium whereby the detected force is fed back to a controller for monitoring of the conditioning process.

Although the final objectives of all the prior art cited above are similar, none of them mount their sensor on the conditioner support arm nor do they use the measurement and application of vibration signals from the pad conditioner for real-time monitoring and control of the conditioning process.

SUMMARY OF THE INVENTION

It has been an object of at least one embodiment of the present invention to a process for monitoring and controlling a CMP pad conditioning process.

Another object of at least one embodiment of the present invention has been to provide an apparatus for implementing said process.

Still another object of at least one embodiment of the present invention has been to make said process and apparatus easy to implement using any available CMP tool set.

A further object of at least one embodiment of the present invention has been to prolong the lives of both polishing pads and conditioner disks.

A still further object of at least one embodiment of the present invention has been to facilitate detection of abnormal conditioner disks thereby averting possible future damage to wafers by the CMP process.

These objects have been achieved by measuring the vibration of the pad conditioner. In the present invention, an accelerometer was mounted on the support arm of the pad conditioner to measure its vibration frequency. The time dependent signal obtained is analyzed by using Fast Fourier Transform (FFT) to convert it to the frequency domain. Abnormal frequency peaks, if detected, serve as guideline for optimization of the pad conditioning process. Real-time monitoring of the conditioning process is achieved by means of a negative feedback loop for controlling the number of sweeps and head pressure of the conditioning body in response to the changes detected through the vibration signature.

BRIEF DESCRIPTION OF THE DRAWINGS

FIG. 1 shows a typical pad conditioning apparatus of the prior art.

FIG. 2 shows the basic apparatus of the present invention.

DESCRIPTION OF THE PREFERRED EMBODIMENTS

Figure 3A:
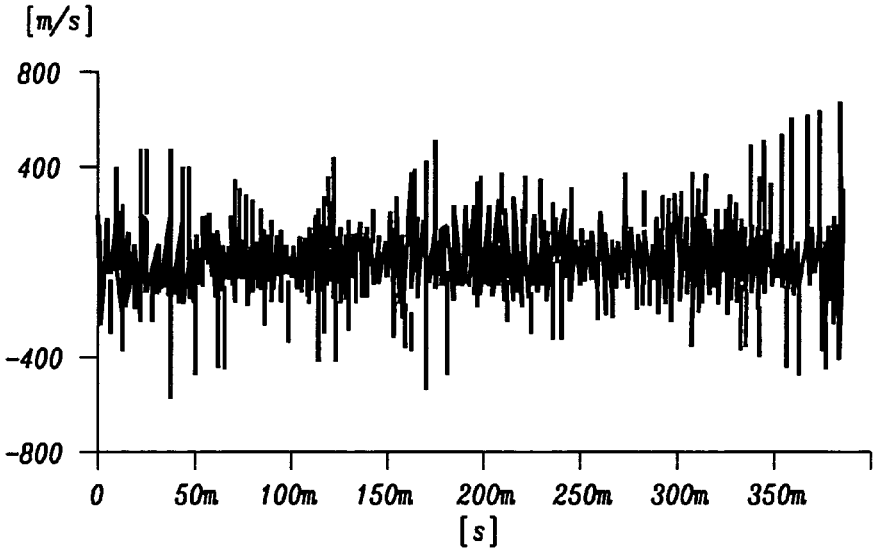
FIGS. 3*a* and 3*b* show a vibration spectrum in its time domain representation and its equivalent frequency domain representation.

The apparatus of the present invention is schematically illustrated in FIG. 2. It includes vibration sensor 21, signal conditioner 22, dynamic spectrum analyzer 23, and visual display unit 24. Our preferred device for vibration sensing has been an accelerometer (for reasons that will be explained below) but related devices such as microphones, reflectometers, Linear Variable Displacement Transformer (LVDT), Strain Gauge, Proximeter (magnetic and inductive), and Laser Vibrometer could also have been used without departing from the spirit of the invention.

Sensor 21 is mounted on support arm 14 of pad conditioner 13. The signal detected by the sensor 21 corresponds to vibrational velocity as a function of time, being therefore a time domain representation. It is amplified by signal conditioner 22 which may be either a Constant Current Line Drive (CCLD) or a charge amplifier. If the CCLD version is selected it may be built-in together with the Dynamic Spectrum Analyser (DSA) and a separate, external signal conditioner would not be required.

Figure 3B:
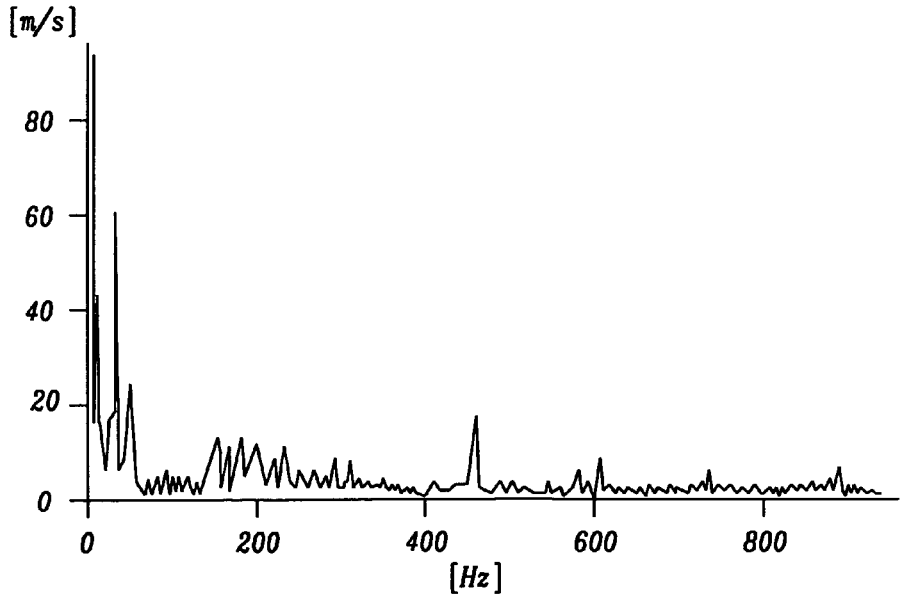

The time domain signal is then transformed into its frequency domain equivalent by the DSA (using a Fast Fourier Transform Algorithm). FIG. 3*a* shows an example of a typical time domain plot while FIG. 3*b* shows its frequency domain equivalent. Although vibration amplitude can be measured in terms of displacement, velocity, or acceleration, velocity was selected because it is a function of time and wear rate is also a function of time. This led to an accelerometer becoming our sensor of choice because acceleration signal can be easily (electronically or by software) integrated to obtain velocity and displacement, and also because of its small physical size and weight, it can be installed in small space without mass loading effects. Thus, an increase in vibration velocity amplitude correlates with an increase in the wear rate of the pad and/or pad conditioner. As a result, the process parameters can no longer be optimized once the pad and/or pad conditioner have worn out. When this happens (i.e. process parameter optimization cannot be achieved after several attempts), the control software can readily issue a warning by sounding an alarm.

The next step is the creation and display of a waterfall plot by cascading a succession of frequency domain spectra during one full sweep of the pad conditioning procedure. At this point (if the system is only partly automated) an operator will be able to determine if the process parameters used were optimum, by observing one or more frequency bands in the waterfall plot, particularly (in this example) the 200 Hz band. The operator can then adjust the appropriate pad conditioning control variables such as sweep rate, head pressure and head rotation rate until all abnormal peaks disappear from the 200 Hz and any other selected bands.

Figure 4:
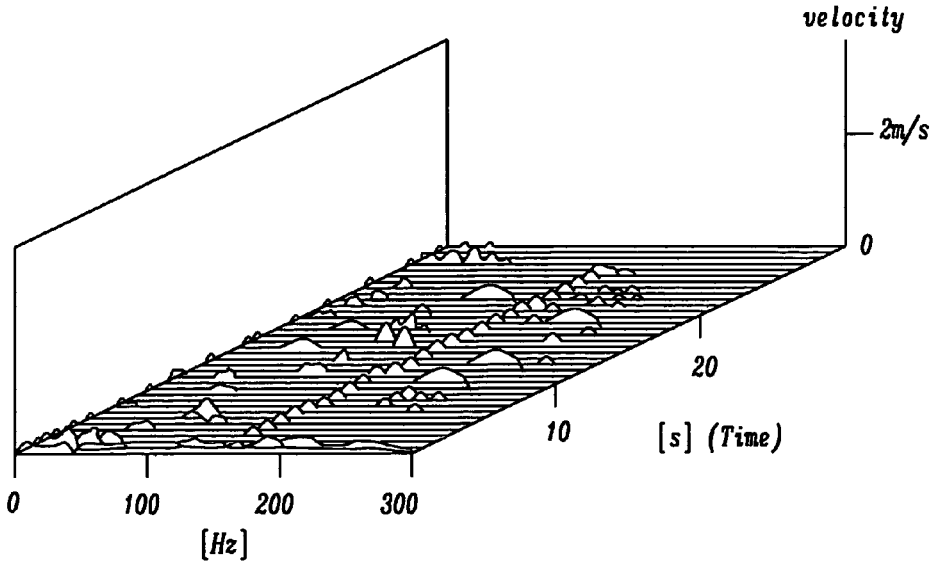
FIG. 4 is a waterfall plot generated by a new or fully conditioned pad.
Figure 5:
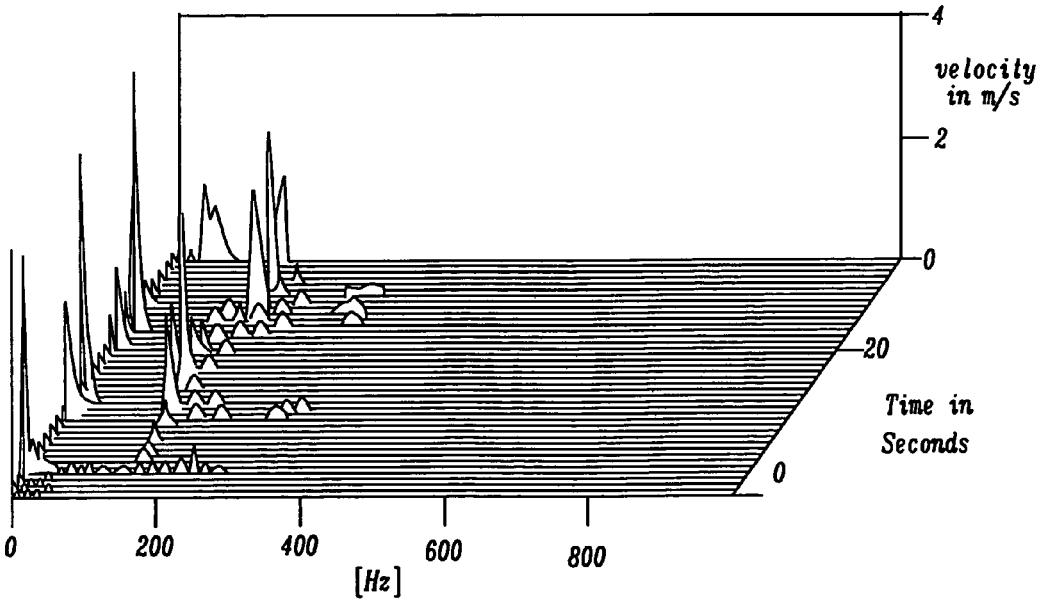
FIG. 5 is a waterfall plot generated by a pad in need of conditioning.

FIG. 4 shows a typical waterfall plot for a new or fully reconditioned polishing pad while FIG. 5 is a similar plot for a used pad in need of conditioning. It is readily seen that, for the new pad, any peaks that are present have very low amplitude and are randomly scattered, the only exception being a set at about 150 Hz (representing the CMP tool structural vibration. On the other hand, the plot for the used pad, in addition to substantial activity at very low frequencies, shows strong activity at, or near, 200 Hz, thereby providing a straightforward means of distinguishing between pads that are suitable for use and pads that are in need of conditioning.

The 200 Hz value is dependent on the mechanical characteristics of the conditioning system. It will vary with the operating parameters of the CMP such as platen speed, polisher speed and number of sweeps i.e. dependent on the CMP operating parameters. It will also vary if different pad materials or different conditioning disk materials are used for conditioning.

Figure 6:
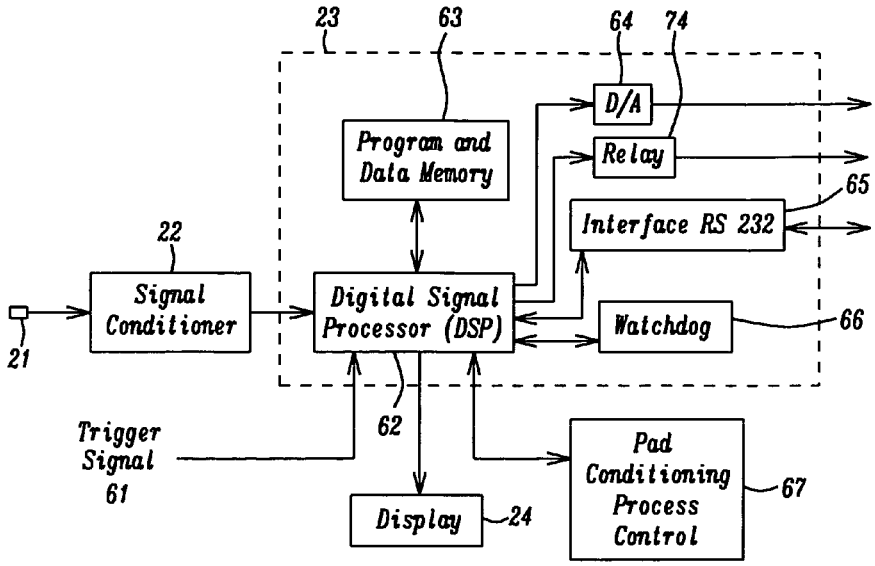
FIG. 6 illustrates the principal system components employed in the present invention to monitor and control a conditioning process.

FIG. 6 is an expanded version of the basic process flow illustrated in FIG. 2. The measurement of a vibration signal starts when the conditioning disk touches the polishing pad, causing trigger signal 61 to be emitted. The time domain signal that is collected using the sensor mounted on the support arm of the pad conditioner is passed to DSP 62 which is controlled by computer program 63. The FFT is performed at the DSP to convert the time domain signal to a frequency domain signal, the data collected being stored in data memory 63. The assembled output of DSP 62 is sent to visual display 24 (FIG. 2). Interface RS 232 (shown as 65) serves as a serial communication port for interfacing to other personal computers or modems for networking etc. while watchdog 66 serves to monitor whether the pre-alarm or alarm has exceeded the preset guardband (i.e. it is a comparator circuit).

In addition to the visual display shown in FIG. 2, the apparatus of FIG. 6 also includes control unit 67 which adjusts the various parameters associated with the pad conditioning process, thereby replacing the human operator who was mentioned earlier. Optimum values for the conditioning parameters are computed by computer 63 and then passed to unit 67 for conversion to the specific voltages needed to control operational variables such as pad conditioner pressure, pad conditioner rotation speed, and platen rotation speed, as well as when to terminate the conditioning process (i.e. the sweep profile).

Experiments were conducted to characterize the impact of the above process parameters in terms of vibration signals. Vibration amplitude was observed to correlate with pad conditioner downward force while increasing pad conditioner rotation speed was seen to result in lower vibration amplitude. Different sweep profiles of the pad conditioner were found to have an effect on the vibration signal. Specifically, increasing the number of sweeps resulted in a lower vibration amplitude. The lowest vibration amplitudes were observed at platen rotation speeds of about 65 rpm. This data allowed the characteristics of process parameters to be modeled and programmed into controller 67 for real-time monitoring and control of the pad conditioning process.

Figure 7:
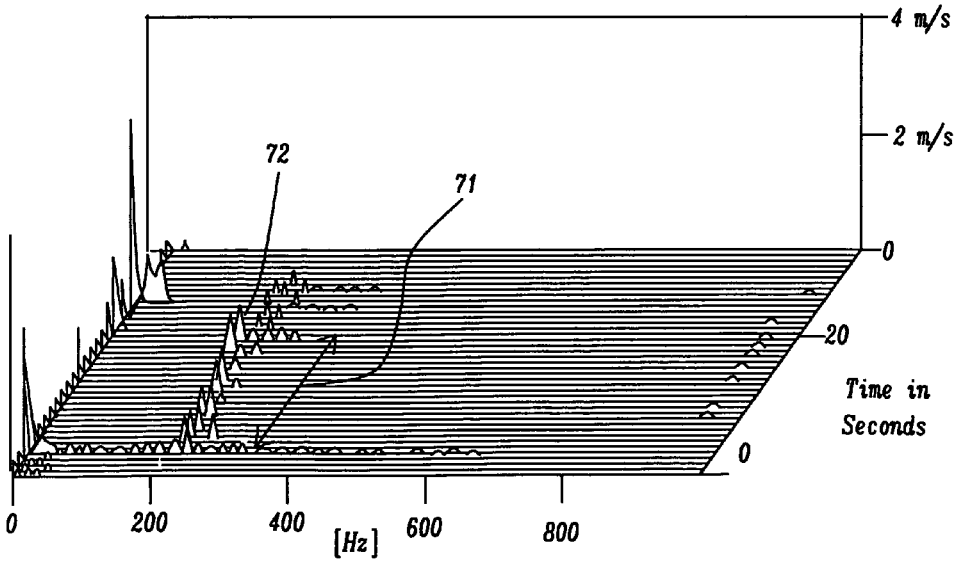
FIG. 7 is a waterfall plot of a pad that is in the process of being conditioned.

FIG. 7 is an example of a waterfall plot generated during a pad conditioning process in which the conditioning parameters were all optimized as discussed above. As can be seen, the frequency peaks at 200 Hz disappear or are reduced after point 72 is passed, allowing conditioning to be terminated after about 15 seconds of total conditioning time (symbolized by line 71), with full confidence that optimum pad renewal has been achieved. In addition to saving time that is more profitably used for performing CMP, this feature also guarantees that no more of the polishing pad's surface is removed than is absolutely necessary.

Figure 8A:
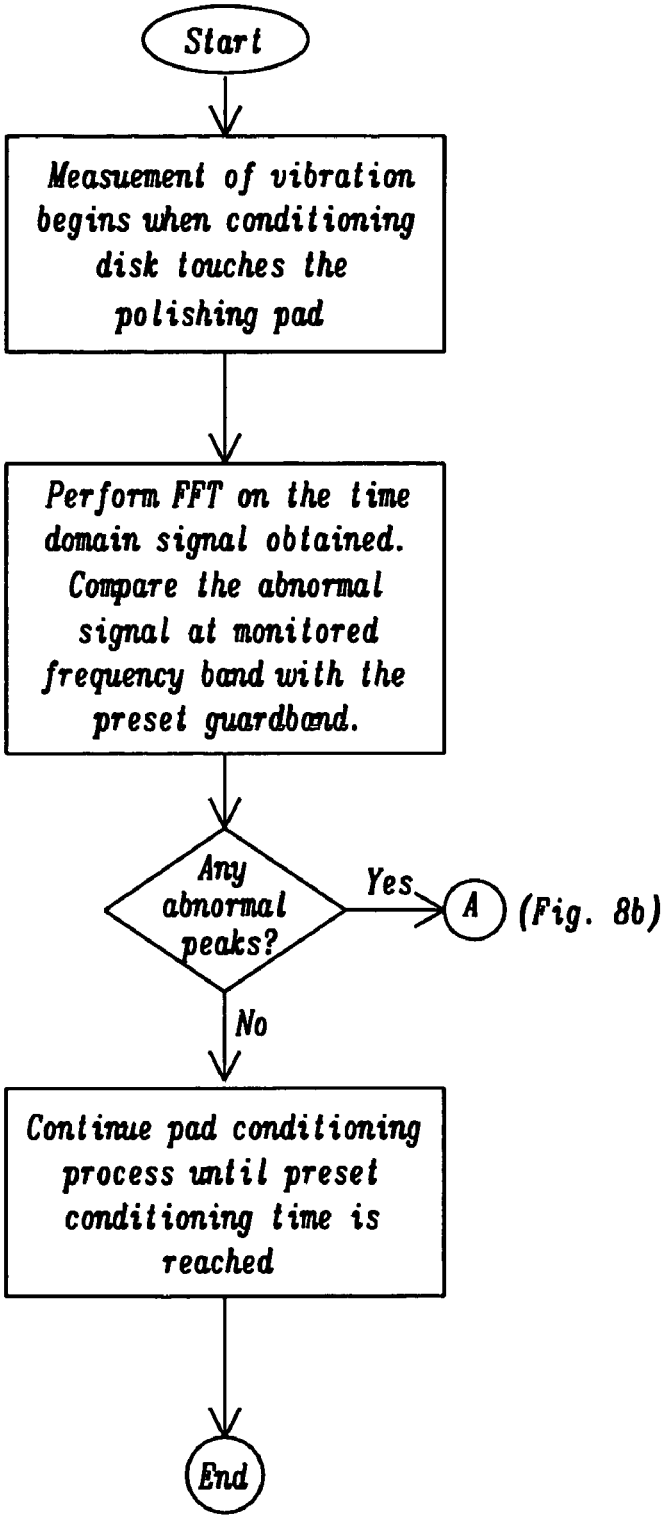
FIGS. 8*a* and 8*b* are a flow chart representation of the process of the present invention.
Figure 8B:
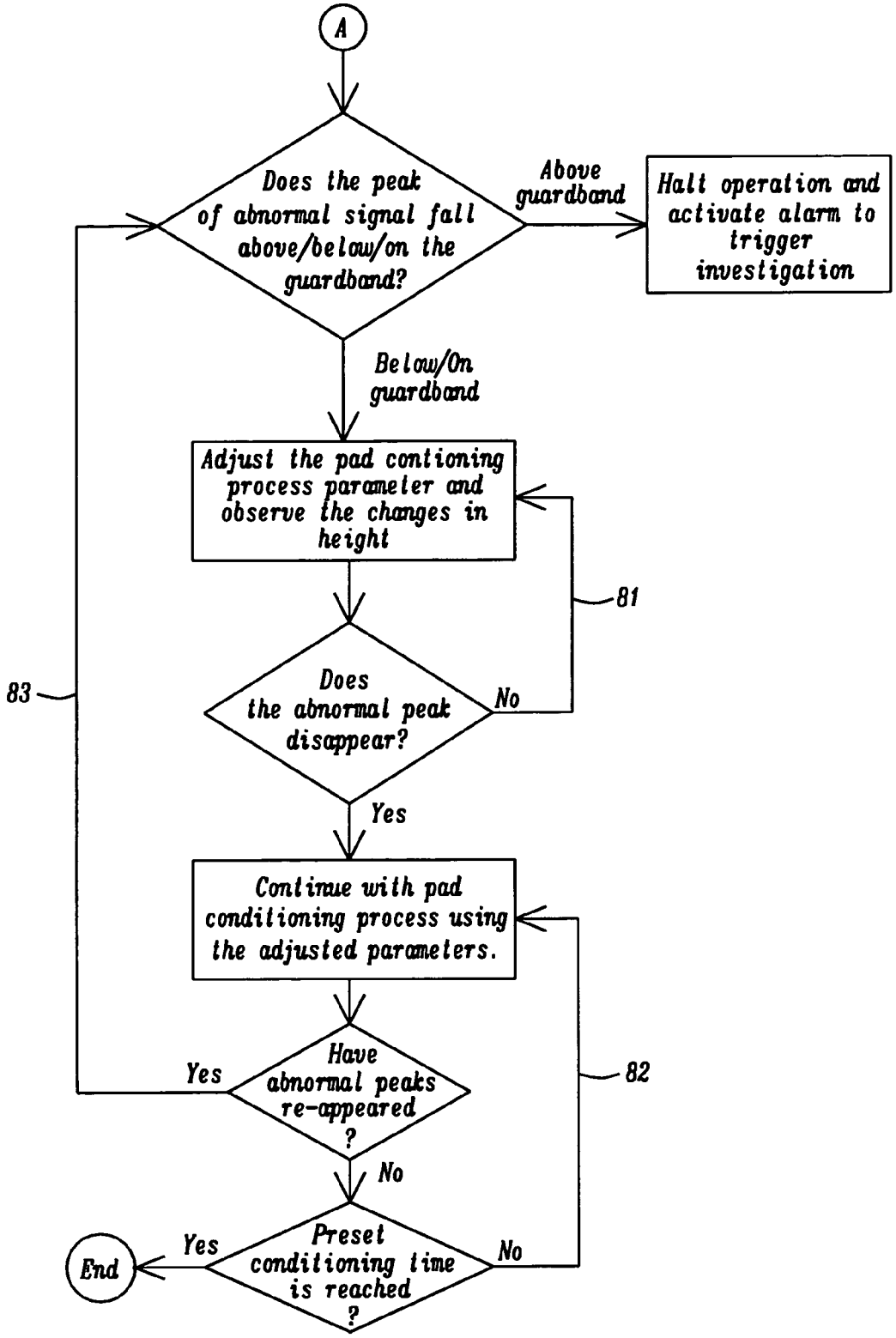

FIGS. 8*a* and 8*b* together constitute a flow chart of the full process of the invention. Beginning at the box labeled "Start" in FIG. 8*a*, the time domain signal is transformed into its frequency domain equivalent and the amplitude at one (or more) specific frequencies (e.g. 200 Hz) is measured. If this measured amplitude is below the minimum value of a preset guard band, the conditioning process is allowed to continue. If abnormal peaks do not appear during a preset time period the process is allowed to proceed without changing conditioning parameters.

If the measured amplitude was above the minimum value of the guard band, then the pad is in need of conditioning and we transfer to FIG. 8*b* via common box A. Now, if the measured amplitude is above the maximum value of the guard band, this indicates a problem such as a non-recoverable pad or an apparatus malfunction. In such a case, the operation is halted and an alarm is sounded to trigger an investigation. If the peaks are below or on the guard band, the process parameters will be adjusted automatically until the peaks disappear (flow chart loop 81). Pad conditioning then continues, based on the final set of parameters, until a preset conditioning time is reached (loop 82) or until abnormal peaks appear again (loop 83). In the latter case, the new peaks are again compared with the preset guard band and the process parameters are again adjusted to effect their removal.

In conclusion, we note the following advantages of the invention:

Easy to implement

A real time monitoring system can be implemented using any available CMP tool set.

Reduced operating costs

Optimization of the pad conditioning process will prolong the lives of both the polishing pad and conditioner disk.

CMP Process enhancement

Real time monitoring allows better control of pad conditioning throughout the pad's life, thereby maintaining good post CMP wafer uniformity. Real time monitoring facilitates detection of abnormal conditioner disks thereby averting any further damage from CMP induced scratches.

What is claimed is:

1. A method to monitor activity of a device used to condition a polishing pad, comprising:

providing a platen to which said pad is attached;

supporting said conditioning device by means of an arm that serves to press said conditioning device against said pad while said platen and said conditioning device rotate;

attaching to said support arm a vibration sensor that outputs a vibration pattern; and through observation and analysis of said vibration pattern in real time, monitoring said device activity, said real-time monitoring being achieved by means of a negative feedback loop for controlling the number of sweeps and head pressure of said conditioning device in response to changes detected in said vibration pattern, whereby various parameters associated with the pad conditioning process are adjusted without human intervention.

2. The method of claim 1 wherein said vibration sensor is selected from the group consisting of microphones, reflectometers, linear variable displacement transformers, strain gauges, magnetic and inductive proximeters, and laser vibrometers.

3. The method of claim 1 wherein said vibration sensor is an accelerometer.

4. The method of claim 3 wherein said accelerometer measures vibration acceleration, from which velocity information may be derived through integration, said velocity information relating to wear in said pad and said conditioner.

5. The method of claim 1 wherein said step of monitoring device activity includes determining when said activity should be terminated.

6. A method for end point detection of a polishing pad conditioning process, comprising:

providing a platen to which said pad is attached;

supporting a conditioning device by means of an arm that serves to press said conditioning device against said pad while said platen and said conditioning device rotate;

attaching to said support arm a vibration sensor that outputs a vibration pattern;

initiating said pad conditioning process;

transforming said vibration pattern from a time domain representation to a frequency domain representation;

monitoring a peak contained within said frequency domain representation until said peak has disappeared or has been reduced to a preset level; and thereby determining that said end point has been reached.

7. The method of claim 6 wherein said vibration sensor is selected from the group consisting of microphones, reflectometers, linear variable displacement transformers, strain gauges, magnetic and inductive proximeters, and laser vibrometers.

8. The method of claim 6 wherein said vibration sensor is an accelerometer.

9. The method of claim 8 wherein said accelerometer measures vibration acceleration, from which velocity information may be derived through integration, said velocity information relating to wear in said pad and said conditioning device.

10. The method of claim 6 wherein said peak contained within said frequency domain representation occurs at about 200 Hz.

11. A process, having process parameters, to condition a polishing pad for use in CMP, comprising:

providing a platen to which said pad is attached;

providing a conditioning device having a support arm;

attaching to said support arm a vibration sensor that outputs a vibration pattern;

initiating said pad conditioning process by rotating said platen and said conditioning device while pressing said conditioning device against said pad whereby said support arm vibrates, thereby causing said vibration sensor to output a vibration pattern;

transforming said vibration pattern from a time domain representation to a frequency domain representation that includes a peak having an amplitude;

comparing said peak amplitude to a guard band having maximum and minimum values;

if said peak amplitude is below said minimum value, the conditioning process is allowed to continue for a first time period;

if abnormal peaks do not appear during said first time period, terminating the process;

if said peak amplitude is above said maximum value, immediately terminating said conditioning process and sounding an alarm;

if said peak amplitude falls within said guard band, adjusting said process parameters through computer control until said peak disappears;

using said adjusted process parameters, continuing said pad conditioning process for a second time period;

if an abnormal peak appears before said second time period ends, again adjusting said process parameters through computer control; and when all abnormal peak have disappeared, ending said process.

12. The process of claim 11 wherein said vibration sensor is an accelerometer.

13. The process of claim 12 wherein said accelerometer measures vibration acceleration, from which velocity information may be derived through integration, said velocity information relating to wear in said pad and said conditioning device.

14. The process of claim 11 wherein said peak contained within said frequency domain representation occurs at about 200 Hz.

15. The process of claim 11 further comprising using said peak amplitude as an indication of how much useful life still remains in said polishing pad and said conditioning device.

16. The process of claim 11 wherein said process parameters further comprise pad conditioner pressure, pad conditioner rotation speed, platen rotation speed, and number of sweeps made by said pad conditioner.

17. The process of claim 11 wherein no more of said polishing pad's surface is removed than is necessary to fully condition said pad.

18. An apparatus to condition, in real time, a polishing pad used for CMP, comprising:

a conditioning device having a support arm, said conditioning device making pressure contact with said polishing pad;

a vibration sensor mounted on said support arm;

a signal conditioner whose inputs include an output of said vibration sensor;

a dynamic spectrum analyzer whose inputs include an output of said signal conditioner;

a visual display unit connected to said dynamic spectrum analyzer; and a negative feedback loop that controls the number of sweeps and head pressure of said conditioning device in response to changes detected in said vibration sensor output.

19. An apparatus to condition a polishing pad, that is attached to a platen, that is used for CMP, comprising:

a conditioning device having a support arm, said conditioning device making pressure contact with said polishing pad;

said pad conditioner and said platen being capable of rotation and said pad conditioner being able to sweep over a surface of said pad conditioner;

mounted on said support arm, an accelerometer having an output that is a plot of support arm vibrational acceleration, and hence, through integration velocity, said accelerometer output being connected as an input to a signal conditioner having an output;

said conditioner output being connected to be a first input to a digital signal processor that further comprises a Fast Fourier Transform capability;

an externally controlled trigger signal connected to be a second input to said digital signal processor;

said digital signal processor having first and second two-way connections to a pad conditioning process controller and to a computer, respectively;

said computer further comprising a control program and a data memory;

said digital signal processor having third and fourth two-way connections to a watch dog unit and to an RS 232 Interface, respectively;

said digital signal processor having an output that is connected to a digital-to-analog converter and to a relay, said digital-to-analog converter and relay serving to drive an alarm and warning light tower; and said RS 232 interface having a fifth two-way connection that serves as a serial communication port for interfacing to other personal computers or modems for networking.

20. The apparatus described in claim 19 wherein said pad conditioning process controller controls pad conditioner pressure, pad conditioner rotation speed, platen rotation speed, and the number of said sweeps made by said pad conditioner.

21. The apparatus described in claim 19 wherein said visual display may be used to indicate when said pad has been fully conditioned.

22. The apparatus described in claim 19 further comprising an output that will trigger an alarm if a pad has been determined to be incapable of being fully conditioned.

* * * * *

UNITED STATES PATENT AND TRADEMARK OFFICE

CERTIFICATE OF CORRECTION

PATENT NO. : 7,163,435 B2
APPLICATION NO. : 11/047117
DATED : January 16, 2007
INVENTOR(S) : Khoon Peng Lim and Kok Eng Lee It is certified that error appears in the above-identified patent and that said Letters Patent is hereby corrected as shown below:

Title Page, Item (73) Assignee: Delete "Tech Semiconductor Singapore Pte. Ltd., Singapore (SG)" and replace with -- TECH Semiconductor Singapore Pte. Ltd., Singapore (SG) --.

Signed and Sealed this

Eighth Day of May, 2007

JON W. DUDAS
*Director of the United States Patent and Trademark Office*